US009027910B2

(12) United States Patent
Braun et al.

(10) Patent No.: US 9,027,910 B2
(45) Date of Patent: May 12, 2015

(54) FUEL METERING DIAPHRAGM WITH BACKING PLATE

(71) Applicant: Walbro Engine Management, L.L.C., Tucson, AZ (US)

(72) Inventors: Matthew A. Braun, Caro, MI (US); Gary J. Burns, Fostoria, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 198 days.

(21) Appl. No.: 13/771,451

(22) Filed: Feb. 20, 2013

(65) Prior Publication Data

US 2013/0234345 A1 Sep. 12, 2013

Related U.S. Application Data

(60) Provisional application No. 61/607,642, filed on Mar. 7, 2012.

(51) Int. Cl.

| | |
|---|---|
| ***F02M 37/00*** | (2006.01) |
| ***F02M 7/20*** | (2006.01) |
| ***F02M 37/02*** | (2006.01) |
| ***F02M 17/04*** | (2006.01) |

(52) U.S. Cl.

CPC ..... *F02M 7/20* (2013.01); *F02M 37/02* (2013.01); *F02M 37/00* (2013.01); *F02M 17/04* (2013.01)

(58) Field of Classification Search

CPC ..... F02M 37/00; F02M 37/02
USPC ..... 261/27, 34.1, 36.1, 36.2, 66, DIG. 52
See application file for complete search history.

(56) References Cited

U.S. PATENT DOCUMENTS 3,454,265 A * 7/1969 Phillips ..... 261/41.5
4,274,376 A * 6/1981 Tsiang et al. ..... 123/360

OTHER PUBLICATIONS

Photographs of a prior art Keihin Sno-Jet carburetor showing a diaphragm in the carburetor, 4 pages.

* cited by examiner

*Primary Examiner* — Robert A Hopkins
(74) *Attorney, Agent, or Firm* — Reising Ethington P.C.

(57) ABSTRACT

In at least some implementations, a carburetor having a fuel metering system including a diaphragm assembly that moves in response to pressure changes in a metering chamber to actuate a metering valve may include a flexible diaphragm adapted to carried by a body of the carburetor at a periphery to define part of the metering chamber. The portion of the diaphragm that defines part of the metering chamber defines a chamber projected area of the diaphragm. A backing plate is attached to the flexible diaphragm and arranged to be located outside the metering chamber. The backing plate having an outer perimeter defining a plate projected area, wherein an area ratio of the plate projected area to the chamber projected area is greater than about 0.1.

11 Claims, 2 Drawing Sheets

FUEL METERING DIAPHRAGM WITH BACKING PLATE

REFERENCE TO CO-PENDING APPLICATION

This application claims the benefit of U.S. Provisional Application No. 61/607,642 filed Mar. 7, 2012, which is incorporated herein by reference in its entirety.

TECHNICAL FIELD

The present disclosure relates generally to carburetors for use with internal combustion engines and, more specifically, to fuel metering system components of such carburetors.

BACKGROUND

Carburetors are devices that can be used to mix fuel with air to power combustion engines. A carburetor may include a fuel metering system that helps control the amount of fuel supplied to air flowing through the carburetor to provide a desired fuel to air ratio of the fuel and air mixture delivered from the carburetor. Some metering systems employ a diaphragm that oscillates during operation to open and close a metering valve. The diaphragm may carry a contact element that engages the valve. The contact element reduces wear on the diaphragm such as would occur if the diaphragm directly engaged a portion of the valve.

SUMMARY

In at least some implementations, a carburetor having a fuel metering system including a diaphragm assembly that moves in response to pressure changes in a metering chamber to actuate a metering valve may include a flexible diaphragm adapted to carried by a body of the carburetor at a periphery to define part of the metering chamber. The portion of the diaphragm that defines part of the metering chamber defines a chamber projected area of the diaphragm. A backing plate is attached to the flexible diaphragm and arranged to be located outside the metering chamber. The backing plate having an outer perimeter defining a plate projected area, wherein an area ratio of the plate projected area to the chamber projected area is greater than about 0.1.

In at least some implementations, a carburetor having a fuel metering system including a diaphragm assembly that moves in response to pressure changes in a metering chamber to actuate a metering valve includes a flexible diaphragm having a chamber side partly defining the metering chamber and an opposite reference side. A first plate is attached at the reference side of the flexible diaphragm and a second plate is attached at the chamber side of the flexible diaphragm. The first plate is the same size or larger than the second plate.

A diaphragm assembly, according to at least some implementations, may be used with a fuel metering system of a carburetor and include first and second backing plates concentrically attached at opposite sides of a flexible diaphragm. The plate attached at the same side of the diaphragm as a contact portion of the assembly is the same size or smaller than the other plate, where the contact portion is configured to actuate a metering valve when installed in the carburetor.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
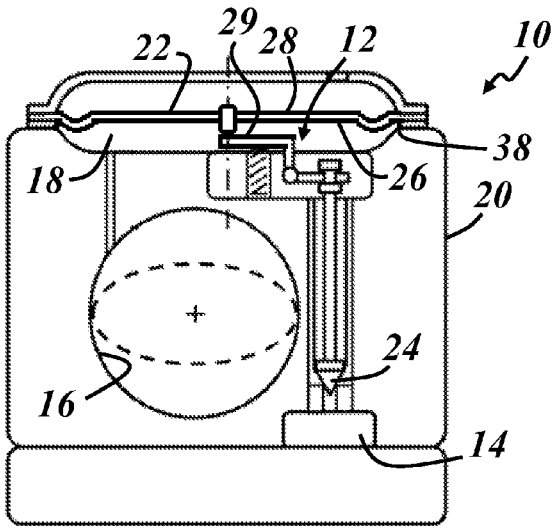
FIG. 1 is a schematic cross-sectional view of a carburetor having a diaphragm metering system with a diaphragm assembly.

Referring in more detail to the drawings, FIG. 1 is a schematic cross-sectional view of a carburetor 10 having a diaphragm-type fuel metering system 12, according to one embodiment. Generally, the fuel metering system is a system configured to deliver doses of fuel from a fuel source 14 to an air passage 16 via various channels, conduits, and/or chambers, one of which is a metering chamber 18. In this non-limiting example the fuel source is an on-board fuel pump, which may be a diaphragm style pump. The air passage 16 is formed through a body 20 of the carburetor to facilitate air flow from the environment to an engine and to mix fuel with the air as it passes therethrough. The metering system 12 includes a diaphragm assembly 22 that moves in response to pressure changes in the metering chamber 18 to actuate a metering valve 24 either directly or via one or more other metering system components.

In operation, a demand for fuel at the engine increases air flow through passage 16, thus reducing fluid pressure in the metering chamber 18 and at a chamber side 26 of the diaphragm assembly 22. A reference pressure, such as atmospheric pressure, acting on an opposite reference side 28 of the diaphragm assembly 22, moves a portion of the assembly 22 toward the carburetor body in a direction that reduces the volume of the metering chamber 18 as fuel is delivered to passage 16. The diaphragm assembly 22 engages a lever 29 that is coupled to the metering valve 24 and opens the metering valve 24 to allow fuel to flow from the fuel source 14 into the metering chamber 18 in replacement. This increases the fluid pressure in the metering chamber 18, reversing the direction of movement of the diaphragm assembly away from the carburetor body 20 in a direction that increases the volume of the metering chamber. This movement facilitates closure of the metering valve 24, causing the metering chamber pressure to decrease and begin a new metering cycle as long as there is a demand for fuel at the engine. The carburetor of FIG. 1 is illustrative in nature, and skilled artisans will appreciate that the teachings presented herein may be applied to any type of carburetor and with various diaphragm metering system configurations.

Figure 2:
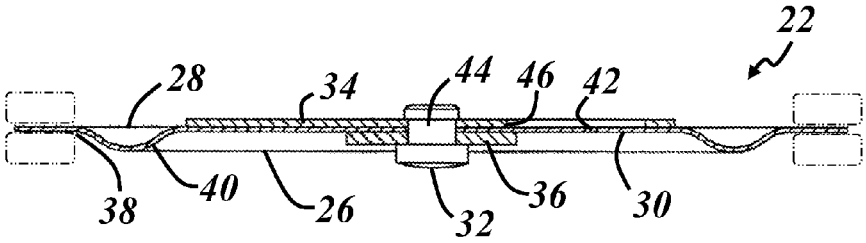
FIG. 2 is a cross-sectional view of a diaphragm assembly, according to one embodiment.

Referring to FIG. 2, a diaphragm assembly 22 according to one embodiment is shown separate from the carburetor, with the chamber side 26 and the reference side 28 indicated. The diaphragm assembly 22 includes a flexible diaphragm 30, a contact portion 32, and may also include one or more backing plates 34, 36 as shown in this example. Flexible diaphragm 30 is the component of the assembly 22 that is responsive to fluid pressure differential changes at its opposite sides 26, 28. Flexible diaphragm 30 is typically a relatively thin, flexible piece of material configured for attachment over a recess formed in the carburetor body so that its chamber side 26 partly defines the metering chamber 18. The attachment may be in the form of a fluid-tight seal at a periphery 38 of the metering chamber. The phantom blocks at the periphery 38 are representative of other carburetor components between which the flexile diaphragm may be clamped, in one manner of attachment, such as a cover, gasket, or carburetor body. A small fluid pressure differential across the diaphragm 30 will cause its center to move in the direction of lower pressure. Any type of material that can be formed so that its movement is sufficiently sensitive to fluid pressure differentials may be used, so long as it meets other performance requirements, such as fuel/alcohol resistance, fatigue strength, tear strength, etc. NBR-coated or impregnated silk fiber materials are suitable, as well as some polymeric films.

To facilitate a sufficient amount of movement, the flexible diaphragm 30 may include a convolution 40, shown as a concave-up U-shape in the cross-section of FIG. 2. Convolution 40 may be molded into the diaphragm 30 during manufacture, or it may be formed by controlled stretching of a flat piece of diaphragm material within the intended periphery 38. Inclusion of the convolution 40 causes the surface area of the portion of the flexible diaphragm 30 within periphery 38 to be larger than the projected area of the periphery. The larger the convolution is (i.e., the more the amount of additional surface area), the larger the overall allowable diaphragm movement is. In this embodiment, the convolution 40 is annular with an outer diameter measured adjacent the periphery 38 and an inner diameter measured where the convolution joins a central portion 42 of the diaphragm, shown flat in the figure. Convolution 40 may be provided with other cross-sectional shapes, other embodiments may include more than one convolution, and convolutions may be located elsewhere along the flexible diaphragm.

Contact portion 32 is a portion of assembly 22 that makes physical contact with other metering system components to actuate the metering valve 24. The contact portion 32 may be made from a metal such as stainless steel or other highly wear-resistant material. In the illustrated embodiment, contact portion 32 is part of button 44. The contact portion 32 of the button 44 is located on the chamber side 26 of the diaphragm 30 and may be in the form of a rivet in one embodiment. To form the button 44 in the embodiment of FIG. 2, for example, a rivet may be inserted through aligned openings in flexible diaphragm 30 and plates 34, 36 from the intended chamber side of the diaphragm 30. Then, the end of the rivet that passes through the aligned openings may be deformed at the intended reference side to form button 44, thereby sandwiching the diaphragm 30 and plates 34, 36 between opposite heads of the button and forming a fluid-tight attachment. Other embodiments may provide the contact portion 32 without the use of a rivet or openings in the diaphragm or plates. For example, an upstanding button or other protrusion may be formed as an integral part of one of the plates 34, 36 and/or one or both plates may be attached to the diaphragm is some other manner.

Backing plates 34, 36 may be provided to stabilize the movement of the flexible diaphragm 30 in response to changing metering chamber pressure. For example, in the absence of any backing plates the portion of the flexible diaphragm that moves in the direction of lower fluid pressure may be uncontrolled and affected by variables such as the pressure distribution inside the metering chamber, fuel entry and exit locations or orientations, or material thickness or stiffness variations across the flexible diaphragm 30, to name a few. In other words, a backing plate can help to ensure that the center of the diaphragm assembly (i.e., the contact portion 32) moves toward and away from the metering lever the desired amount even if an off-center portion of the flexible diaphragm 30 tends to be more responsive because the plate distributes load across the diaphragm surface.

Backing plates are typically formed from a relatively high stiffness material such as stainless steel or another metal, are relatively thin (e.g., about 0.25 mm), and may include openings or cut-outs 46 to reduce inertia or otherwise affect vibration or other dynamic characteristics of the diaphragm assembly 22. In embodiments such as those shown in the figures where backing plates 34, 36 are included, the plates 34, 36 may be concentrically arranged and attached at respective opposite sides 28, 26 of the flexible diaphragm 30.

According to one embodiment, the backing plate 34 is attached at the reference side 28 of the flexible diaphragm 30 and is arranged to be located outside of the metering chamber. The backing plate 34 is the same size or larger than the backing plate 36 attached at the chamber side 26 of the diaphragm 30. As will be described below by way of example, this unconventional arrangement of backing plates has been demonstrated to enhance certain carburetor performance characteristics. The relative sizes of the backing plates 34, 36 may be characterized in numerous ways to realize this and/or other benefits. In the particular embodiment shown in FIG. 2, for example, the plates 34, 36 are generally circular, with plate 34 at reference side 28 having a diameter about 2.8 times that of plate 36 at the chamber side 26. This is of course a non-limiting example. In one embodiment, the ratio of the diameter of the backing plate 34 at the reference side 28 of the diaphragm 30 to the diameter of the backing plate 36 at the chamber side 26 of the diaphragm is 1.0 or greater. In another embodiment, this diameter ratio is in a range from about 1 to about 4 and may preferably be about 2.5 or greater.

Figure 3:
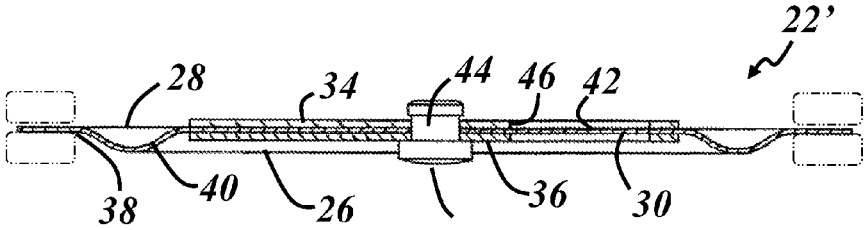
FIG. 3 is a cross-sectional view of a diaphragm assembly, according to another embodiment.

FIG. 3 illustrates another embodiment of a diaphragm assembly 22' in which plate 34 at reference side 28 is the same size or larger than plate 36 at chamber side 26. In this particular example, the plates 34 and 36 are the same size. Both of the examples illustrated in FIGS. 2 and 3 are constructed such that the projected area of the outer perimeter of plate 36 at the chamber side lies within the outer perimeter of plate 34 at the reference side. At least one of the backing plates may have a diameter about the same as the inner diameter of annular convolution 40, or less than the inner diameter of the convolution in some embodiments.

Backing plates 34, 36 may also be characterized in terms of the projected areas of their outer perimeters and/or relative to the size and projected area of the periphery of the metering chamber. In one embodiment, the backing plate 34 at the reference side 28 of the diaphragm 30 has an outer perimeter that defines a projected area, and an area ratio of this projected area to the projected area of the chamber periphery is greater than about 0.1. In another embodiment, this area ratio is in a range from about 0.1 to about 0.9. In yet another embodiment, the area ratio is in a range from about 0.35 to about 0.5. It will be apparent to the skilled artisan that it is possible to construct diaphragm assemblies including these dimensional relationships between the periphery of the metering chamber 18 and the backing plate 34 at the reference side 28 of the flexible diaphragm 30 even in the absence of a backing plate 36 at the chamber side 26 of the diaphragm 30.

Figure 4:
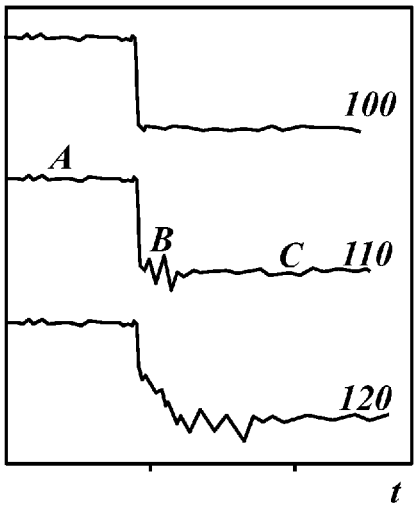
FIG. 4 is a chart showing engine performance characteristics when fitted with carburetors having diaphragm assemblies according to different embodiments.

Experimental results with diaphragm assemblies constructed in accordance with one or more of the above embodiments have confirmed certain carburetor performance enhancements. FIG. 4 is a chart that includes qualitative representations of carburetor performance (in terms of engine performance) with different configurations of diaphragm assemblies. The chart shows three lines 100, 110 and 120. Each line represents the rpm as a function of time for an engine equipped with carburetors having different metering diaphragm assemblies as outlined below.

Line 100 is representative of the particular embodiment of FIG. 2, in which the diaphragm assembly 22 includes a backing plate 34 attached at the reference side 28 of the flexible diaphragm 30 that is larger than the backing plate 36 attached at the chamber side 26, where the plate-to-plate diameter ratio is about 2.8 and the area ratio of the plate 34 at the reference side 28 to the chamber periphery is between about 0.40 and 0.45. The diameter of the backing plate 34 at the reference side 28 of the diaphragm 30 is approximately the same as the inner diameter of the convolution 40 formed in the diaphragm 30.

Line 110 is representative of the particular embodiment of FIG. 3, in which the diaphragm assembly 22 includes a backing plate 34 attached at the reference side 28 of the flexible diaphragm 30 that is the same size as the backing plate 36 attached at the chamber side 26, so that the plate-to-plate diameter ratio is about 1.0 and the area ratio of the plate 34 at the reference side 28 to the chamber periphery is between about 0.40 and 0.45. The diameter of the backing plates 34, 36 is approximately the same as the inner diameter of the convolution 40 formed in the diaphragm 30.

Line 120 is representative of a comparative example in which the diaphragm assembly 22 includes a backing plate 34 attached at the reference side 28 of the flexible diaphragm 30 that is smaller than the backing plate 36 attached at the chamber side 26. The plate-to-plate diameter ratio is about 2.8, but the larger plate 36 is at the chamber side 26 of the diaphragm 30. The area ratio of the plate 34 at the reference side 28 to the chamber periphery is less than 0.1 (between about 0.05 and 0.06).

Each line 100-120 may be divided into three regions along the horizontal axis: A—throttle open position, steady state; B—throttle idle position, transient state; and C—throttle idle position, steady state. FIG. 4 qualitatively shows differences in performance characteristics among the three examples. Apparent in this particular chart is the difference in the duration of the transient state. Line 100 indicates the shortest transient period when the throttle position is changed from open to idle position. Line 120 shows the longest transient period, and line 110 indicates a transient period having a length between the other two. In other words, the engines equipped with carburetors having metering diaphragm assemblies according to the particular embodiments of FIGS. 2 and 3 may be said to "settle" more readily or smoothly when coming down to idle. The demonstrated effect is only one example and is non-limiting—i.e. all embodiments may not demonstrate the same settling effect, and other performance characteristics may be improved.

In fact, the experimental examples indicate that modification of backing plate sizes and their dimensional ratios relative to one another and relative to metering chamber dimensions may be used to affect carburetor performance characteristics. As such, a method of modifying a performance characteristic of a carburetor having a diaphragm metering system including a diaphragm assembly may be described. One embodiment of the method includes the step of varying the size of a backing plate attached to a reference side of the flexible diaphragm. The performance characteristic may be the length of the transient period as demonstrated in FIG. 4, or it may be some other characteristic, such as the maximum rpm range during the transient period, the length of or the rpm range in a different transient period, or the maximum rpm range while at engine idle or at a throttle open position.

Figure 5A:
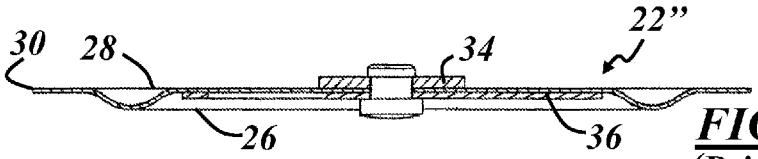
FIG. 5A (Prior Art)
FIG. 5A is a cross-sectional view of a conventional diaphragm assembly, shown at a datum position.
Figure 5B:
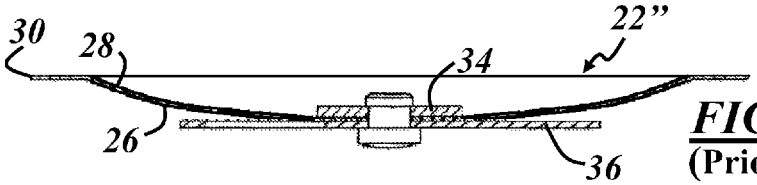
FIG. 5B (Prior Art)
FIG. 5B is the diaphragm assembly of FIG. 5A, shown in an actuating position.

FIGS. 5A-6B illustrate one possible effect of different backing plate configurations. FIG. 5A shows a conventional diaphragm assembly 22" at a datum position, and FIG. 5B shows the same assembly at an actuating position (i.e., extended toward the metering lever). This configuration corresponds to line 120 in FIG. 4. In this example, the plate 36 at the chamber side 26 of the diaphragm 30 is larger than the plate 34 at the reference side 28 of the diaphragm 30. As shown in FIG. 5B, the larger plate 36 may at least partly separate from or lose contact with the flexible diaphragm 30 at locations radially away from the center of the assembly due to the curvature of the flexible diaphragm. While in transition from the datum position to the actuating position, the plate 34 has additional degrees of freedom, may be allowed to tilt, and may not be effective to help stabilize diaphragm movement. The flexible diaphragm may move differently and/or bow or sag more when it loses contact with the backing plate 34.

Figure 6A:
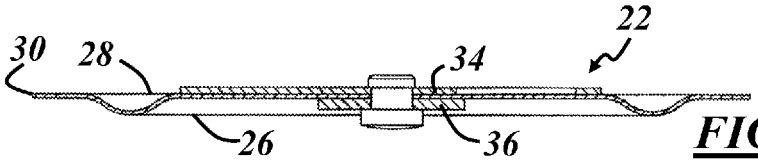
FIG. 6A is the cross-sectional view of the diaphragm assembly of FIG. 2, shown at a datum position.
Figure 6B:
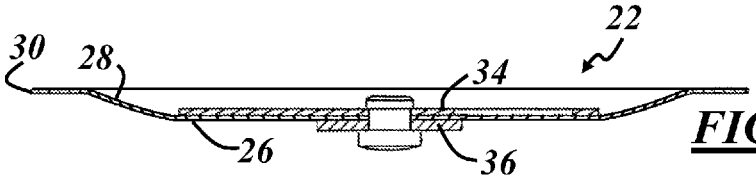
FIG. 6B is the diaphragm assembly of FIG. 6A, shown in an actuating position.

FIG. 6A shows the diaphragm assembly 22 of FIG. 2 and corresponds to line 100 in FIG. 4. In this embodiment, the backing plate 34 at the reference side 28 of the diaphragm 30 is larger than the plate 36 at the chamber side 26 of the diaphragm 30. As shown in FIG. 6B, the larger plate 36 may remain in contact with the flexible diaphragm 30 across the whole area of the larger plate 36 so that the central portion of the diaphragm 30 is generally flat as it moves toward the metering lever. With the plate 36 and flexible diaphragm pressed together while in transition from the datum position to the actuating position, diaphragm movement may be more stabile with the plate 36 helping to distribute load across a larger area of the diaphragm 30. With diaphragm movement more dependent on the backing plate 36, the effects of bows, sags, or other changes that may occur in the flexible diaphragm 30 over time due to fatigue, temperature changes, interaction with fuels and the environment, etc. may be minimized. Diaphragm travel may thus be determined, more or less, by the convolution rather than by the convolution plus a sag factor. While not intended to be bound by any particular theory, this may at least partly explain the results of FIG. 4, with more stable diaphragm movement corresponding to a shorter transient period when the engine comes down from idle.

While the forms of the disclosure herein disclosed constitute presently preferred embodiments, many others are possible. It is not intended herein to mention all the possible equivalent forms or ramifications of the disclosure. It is understood that the terms used herein are merely descriptive, rather than limiting, and that various changes may be made without departing from the spirit or scope of the disclosure.

The invention claimed is:

1. A carburetor having an air passage and a fuel metering system for supplying fuel to the air passage and including a diaphragm assembly that moves in response to pressure changes in a fuel metering chamber to actuate a fuel metering valve, the diaphragm assembly comprising:

a flexible diaphragm having a fuel side and an opposite reference side and carried by a body of the carburetor at a periphery of the diaphragm with the fuel side at least in part defining the fuel metering chamber and normally in contact with fuel in the fuel metering chamber and in operation supplying fuel to the air passage, the portion of the diaphragm that defines part of the fuel metering chamber defining a chamber projected area of the fuel side of the diaphragm; and a backing plate attached to the reference side of the flexible diaphragm and outside of the fuel metering chamber, the backing plate having an outer perimeter defining a plate projected area, wherein an area ratio of the plate projected area to the fuel metering chamber projected area of the fuel side of the flexible diaphragm is greater than about 0.1.

2. The carburetor of claim 1, wherein the area ratio is in a range from about 0.1 to about 0.9.

3. The carburetor of claim 1, wherein the area ratio is in a range from about 0.35 to about 0.5.

4. The carburetor of claim 1, wherein the flexible diaphragm includes an annular convolution having an inner diameter and the backing plate has an outer diameter that is less than or equal to the inner diameter of the convolution.

5. A carburetor having an air passage and a fuel metering system for supplying fuel to the air passage including a diaphragm assembly that moves in response to pressure changes in a fuel metering chamber to actuate a fuel metering valve, the diaphragm assembly comprising:

a flexible diaphragm having a fuel chamber side partly defining the fuel metering chamber, normally in contact with fuel in the fuel metering chamber and in operation supplying fuel to the air passage, and an opposite reference side;

a first plate attached at the reference side of the flexible diaphragm and outside of the fuel metering chamber; and a second plate attached at the chamber side of the flexible diaphragm and in the fuel metering chamber, and the first plate is the same size or larger than the second plate.

6. The carburetor of claim 5, wherein the second plate has an outer perimeter that lies within an outer perimeter of the first plate.

7. The carburetor of claim 6, wherein each outer perimeter is generally circular and a diameter ratio of the first plate diameter to the second plate diameter is greater than or equal to 1.

8. The carburetor of claim 7, wherein the diameter ratio is in a range from about 1 to about 4.

9. The carburetor of claim 8, wherein the diameter ratio is about 2.5 to about 4.

10. A diaphragm assembly for use with a fuel metering system of a carburetor, the diaphragm assembly comprising:

a flexible diaphragm having a fuel side and an opposite reference side and the fuel side configured to define at least part of a fuel metering chamber of a carburetor;

first and second backing plates concentrically attached at opposite sides of the flexible diaphragm, the first plate is attached at the reference side of the diaphragm;

a contact portion on the fuel side of the diaphragm and configured to actuate a metering valve when installed in the carburetor;

the second plate is on the fuel side of the diaphragm; and the second plate has an area smaller than an area of the first plate and the area of the first plate is greater than 0.1 of the area of the fuel side of the diaphragm defining in part the fuel metering chamber and exposed to fuel in the fuel metering chamber when the diaphragm is assembled in the carburetor and the carburetor is in use.

11. The diaphragm assembly of claim 10, wherein the flexible diaphragm includes an annular convolution and the first plate has an outer diameter about the same size as an inner diameter of the annular convolution.

* * * * *